United States Patent [19]

Nielsen

[11] Patent Number: 4,990,129

[45] Date of Patent: Feb. 5, 1991

[54] SWINGING BUCKET ULTRACENTRIFUGE ROTOR, SAMPLE TUBE AND ADAPTER

[76] Inventor: Steven T. Nielsen, 1126 W. Knickerbocker Dr., Sunnyvale, Calif. 94087

[21] Appl. No.: 232,813

[22] Filed: Aug. 16, 1988

[51] Int. Cl.[5] ..... B04B 5/02

[52] U.S. Cl. ..... 494/20; 494/44; 494/64; 494/68

[58] Field of Search ..... 494/16–21, 494/44, 45, 64, 68, 81, 85, 43, 31, 33; 422/72

[56] References Cited

U.S. PATENT DOCUMENTS

| | | | |
|---|---|---|---|
| 2,875,994 | 3/1959 | Anderson | 494/20 |
| 3,266,718 | 8/1966 | Stahl et al. | 494/81 |
| 3,578,240 | 5/1971 | Eberle | 494/20 |
| 3,600,900 | 8/1971 | Buddecle | 494/20 |
| 4,098,456 | 7/1978 | Bayham | 494/21 |
| 4,451,250 | 5/1984 | Romanauskas | 494/16 |
| 4,472,276 | 9/1984 | Taylor . | |
| 4,548,596 | 10/1985 | Sutton, III et al. | 494/20 |
| 4,553,955 | 11/1985 | Lam et al. | 494/16 |
| 4,692,137 | 9/1987 | Anthony | 494/85 |
| 4,738,656 | 4/1988 | Piramoon et al. | 494/16 |
| 4,801,290 | 1/1989 | Gunter | 494/16 |
| 4,832,678 | 5/1989 | Sleeran | 494/16 |

FOREIGN PATENT DOCUMENTS

| | | |
|---|---|---|
| 0290686 | 11/1988 | European Pat. Off. . |
| 2200579A | 8/1988 | United Kingdom . |

OTHER PUBLICATIONS

Beckman Catalog, "Rotors, Tubes & Accessories", PL-174T TLA-100.3; DS-677; pp. 32–35, ©1985.

DuPont Catalog, "Rotors, Tubes, Bottles, and Adapters . . . ", E-85821 issued Apr., 1987, pp. 78 and 79.

Seton Scientific Catalog, "Ultracentrifuge Tubes and Accessories", ©1987, p. 1.

*Primary Examiner*—Frankie L. Stinson

*Attorney, Agent, or Firm*—Skjerven, Morrill, MacPherson, Franklin & Friel

[57] ABSTRACT

An adapter preferably of ultra high molecular weight polyethylene is provided for use with a conical centrifuge tube in an ultracentrifuge swinging bucket rotor hole and is designed to allow the easy removal of the adapter and tube after centrifugation. At the top of the adapter is an integral annular rim with an outside diameter equal to that of a cylindrical upper portion of the centrifuge tube and with a minimal clearance to the diameter of the rotor hole. Immediately below the annular rim and adapter diameter reduces to a lesser diameter and continues until intersection with a hemispherical bottom region. The internal configuration of the adapter has a tapered conical section ending in a reduced diameter hemisphere, the internal taper and hemisphere of the adapter exactly matching the exterior of supported conical portion and hemispherical termination end of the sample tube.

21 Claims, 1 Drawing Sheet

SWINGING BUCKET ULTRACENTRIFUGE ROTOR, SAMPLE TUBE AND ADAPTER

FIELD OF THE INVENTION

The present invention is directed to centrifuge tube adapters and more particularly to adapters for use with conical tubes used in ultracentrifuge swinging bucket rotors.

BACKGROUND OF THE INVENTION

Ultracentrifuge containers or sample tubes have been developed in a variety of sizes, materials, wall thicknesses and sealing means. Tube materials provide a range of chemical resistance, operating conditions, and clarity for observing samples. Wall thickness provides a range of operating speeds, and sample retrieval by puncturing or slicing of the tube. Sealing means include those of heat sealing, screw caps with elastomeric gaskets, crimping, swaging and compressing all to provide degrees of reliability and reusability of the tubes. A range of diameters and lengths provide convenient chambers for particular separations within time and speed constraints. Until recently, all ultracentrifuge tubes were manufactured with cylindrical side walls closed on the bottom with a hemisphere.

Ultracentrifuge tubes with hemispherical bottoms have proven to be the most easily removed from ultracentrifuge rotor holes. Lower speed centrifuge applications, typically less than 25,000 rpm, do not generate sufficient hydrostatic pressures to deleteriously affect the removal of tubes from rotor holes. Ultracentrifuge rotors spinning in the range of about 25,000 to about 100,000 rpm generate extremely high pressures in the liquid contents of the tubes and cause creep, or time-dependent deformation of the tube dimensions. Particularly at the bottom portions of the tube forces of 600,000 g's may be encountered. Pressures of 32,000 psi can exist dependent on the rotor speed and the sample mass. Thus a sample tube weighing just 3 grams may well have a weight of 1 ton in use due to the centrifugal forces. After centrifugation has been completed, appreciable time is required to allow relaxation and removal of the tubes from the rotors. It has been found that a rotor hole with a cylindrical top section and a hemispherical bottom and corresponding to the tube shape facilitates the removal of the tube, as the mating surfaces of the rotor and tube hemispheres provide the least possibility of taper or locking interference.

One disadvantage of the cylindrical tube with a hemispherical bottom is the relatively large surface area provided by the bottom of the tube with the result that sample material to be collected, i.e., a band of precipitate or other desire fraction, is dispersed over the hemispherical internal surface of the tube. An improved tube configuration for sample concentration is a tube with a cylindrical upper section closed on the bottom with a reduced diameter hemisphere, the transition between diameters being accomplished through a conical section. This tube is commonly referred to as a conical tube.

For many years the conical tube has been used in low, medium and so-called superspeed centrifuges up to the rotating speeds of approximately 25,000 rpm. The conical tubes in these applications are made with thick walls, e.g., 0.050 inches (1.5 mm) thick, and are self-supporting in that liquid support by the tube contents is not required to prevent collapse of the tube. Adapters are provided which support the tube in the conical transition between the cylindrical upper portion and the reduced diameter hemispherical portion. The adapters are often made of rigid polymer materials such as polyacetal and polypropylene or elastomers such as Neoprene and thermoplastic rubbers. In these cases the pressures generated by the liquid inside the tube are not high, and the adapters are normally easily extracted from the rotor hole and the tubes easily extracted from the adapters.

Lam and Williams, "Multiangle Adapter for Fixed Angle Centrifuge Rotor," U.S. Pat. No. 4,553,955, describes a centrifuge rotor into which is inserted a long-length adapter at selected rotational alignment to provide various angles of use of centrifuge tubes with a conical transition.

Anthony, "Split Tube Centrifuge Rotor Adapter," U.S. Pat. No. 4,692,137, describes a long-length centrifuge adapter split in two sections longitudinally to facilitate the removal of straight-wall tubes with hemispherical bottoms from the adapters.

Romanauskas, "Inside Adapter for a Sample Container," U.S Pat. No. 4,451,250 describes an application in vertical rotors where the rotor spin axis is coincident with the longitudinal axis of the tube. An adapter is placed inside the normally sealed centrifuge tube and reduced volume of fluid sample resides in a sector-shaped chamber in the adapter.

Adapters for open-top tubes in swinging bucket and fixed angle rotors have previously been developed. Typically the adapters are constructed of polyacetal, a strong, lubricious and dense thermoplastic material. The adapters are sold by many centrifuge companies. The adapters extend to the top of the rotor hole, and a sample tube of a lessor diameter than the rotor hole fits inside the adapter. The speed of centrifugation must be reduced in consideration of the adapter density and the drop of liquid level caused by the additional clearance of the tube diameter in the adapter. Because of reduced speed and extension of the adapter to the top of the rotor hole, removal of the tube from the adapter and the adapter from the hole is relatively easily accomplished.

One recent application of conical tubes in fixed angle rotors is the use of a microcentrifuge tube with attached cap in conjunction with a plastic adapter. The combination of such tube and adapter is sold by Beckman Instruments, Inc. for use in their product number TLA-100.3, fixed angle rotor, and is described as a "conical bottom microcentrifuge tube with special adapters." The microcentrifuge tube is a rigid, self-supporting container with a cap and must be used at speeds reduced 50% from the maximum operating speed of the rotor which is 100,000 rpm. The tube and adapter fit into a hole which is inclined 30° from the spin axis of the rotor. The outside diameter of the overall adapter is straight and slightly less than the inside diameter of the rotor hole. The rotor speed reduction is presumably required to prevent leakage of the tube cap and to facilitate removal of the adapter which otherwise tends to become fixed in the rotor hole.

The first application of a thin wall, open top, conical tube in an ultracentrifuge rotor is sold by Seton Scientific Co. under the trademark "UltraCone." The primary application is in swinging bucket rotors where the longitudinal axis of the tube and rotor during ultracentrifuging is at 90° to the spin axis of the rotor. Thin wall tubes are used for achieving maximum fluid volume and for ease of puncturing the tube wall for sample retrieval at various levels of a tube subsequently removed from the rotor. The conical tube/adapter combination can be used at the maximum speed and density of which the rotor is capable. The adapter is made of a rigid polymer material such a Noryl plastic, and the configuration of the adapter outside surface is a cylinder adjacent to a hemispherical bottom section. The adapter internal surface is a tapered surface adjacent to a hemispherical bottom, and the conical portion of the tube placed into the adapter conforms exactly to the internal mating surface provided by the adapter. The adapter is used at the bottom of the rotor hole under the conical region of the tube, and the upper cylindrical portion of the tube fits the rotor hole. The thin wall tube must be completely filled with fluid sample in order to provide adequate support to the tube wall during centrifugation.

One problem encountered in the use of the Seton UltraCone adapter is the tendency for the adapter to become fixed (stuck) in the bottom of the rotor bucket particularly after long runs at high temperatures. Various thin wall thermoplastic conical tubes when used with an adapter made of a rigid material such as a modified phenylene-oxide based resin also become fixed in the adapter. Both circumstances cause difficulty to the centrifuge user because the separated components of the tube original sample components can be agitated and remixed during the attempt to remove a sticking tube/adapter from the rotor hole. Another problem encountered is the cracking of the adapters after repeated use. The amount of strain experienced by the adapter in tension as it expands to meet the also expanding rotor bucket is not considered high when compared to noncentrifugal strain levels in other plastic applications, but the stress level is extremely high and causes low cycle fatigue in a short period of time. The effects of fatigue are increased by temperature. In ultracentrifugation 20° C. is considered a high temperature but in noncentrifugal environments it is considered a low temperature. This is evidence that plastic applications in the ultracentrifuge impart a stress environment unusual for plastics and do not allow the use of material and design data generated in more conventional environments.

The liquid contents of a typical conical tube can exert more than 35,000 psi in the lower region of the adapter. This tremendous pressure in combination with self-induced load of the adapter and rotor bucket cause the bucket rotor to increase in diameter during centrifugation. The plastic adapter, captured between the highly pressurized fluid at the bottom of the horizontal spinning tube and the expanding internal surface of the rotor bucket, also increases in diameter. The rotor bucket having expanded within its elastic limit immediately returns to its original size after centrifugation, but the adapter and tube, constructed of polymers with viso-elastic properties, decrease in diameter more slowly and are therefore tightly held in the rotor hole and adapter hole respectively for periods of 4–10 hours, overnight or longer, particularly after long multi-hour, high temperature centrifuging runs. It is the extremely high pressure and g-force fields and resulting difficulties in adapter/tube behavior that distinguish the application of the conical tube in ultracentrifuges from that of superspeed (i.e. 7000 rpm to 25,000 rpm) centrifuges.

Because clearances between the tube and adapter and adapter and rotor hole are significantly reduced after centrifugation, an adapter made from a material with a low coefficient of friction is desirable to facilitate removal of the tube from the adapter and the adapter from the rotor hole. Since pressures generated are so high, the outside tube surface is essentially hydroformed against the corresponding surface of the adapter. Any surface irregularities from machining or molding also can cause the tube to lock itself into the adapter.

Particularly in long hour runs, for example in concentrating RNA (ribonucleic acid), the use of Noryl plastic adapters of constant sidewell diameter resulted in severe sticking of both the sample tube in the rotor and the adapter in the rotor. Substituting of Delrin plastic adapters for the Noryl adapters to solve a simultaneous cracking problem failed to solve the sticking problem. Water was placed at the bottom of the rotor cavity to absorb the centrifuging stress and shock but this was not successful in solving the sticking problem.

Generally swinging bucket rotors can be operated at design speed with the buckets containing components of density less than 1.2 grams per cc. If any component, such as the tube, adapter material or fluid contents are greater than 1.2 grams per cc, the rotor speed has to be reduced so that the load on the rotor does not exceed design specifications. So that a variety of centrifuge tests can be performed, it is desirable that a tube adapter exhibits good chemical and stress cracking resistance and that it can be sterilized by various means such as a steam autoclaving or solvent immersion.

Although tube adapters have been previously developed for use in ultracentrifuge rotor bores, adapters have not been designed which could be used in swinging bucket rotors at maximum rated speed of the rotor and could be easily extracted from the rotor hole with no agitation of the contents of the tube. The swinging bucket rotor applies a symmetrical pressure and relative high g-field load to all components it contains. The use of tubes and adapters in vertical and fixed angle rotors has not been found to be as difficult since the centrifugal loading on the adapter is asymmetrical and applies a centrifugal vector component perpendicularly to the spin axis allowing a gap to exist between the adapter and hole on the inward or centripetal side of the adapter.

SUMMARY OF THE INVENTION

It is desirable that a conical centrifuge tube with thin walls be used in swinging bucket ultracentrifuge rotors for long runs at room temperature. It is also advantageous that an operator be able to easily remove the tube from a conical adapter for retrieval of the fluid sample and the adapter from the rotor for cleaning and possible later use of straight wall tubes. An adapter should exhibit properties of machinability, lubricity, chemical and stress cracking resistance, low density, toughness and that these material properties be used in conjunction with a mechanical design which allows for adequate tube support. All of the above advantages are addressed by the tube adapter of this invention.

The present invention is directed to an ultracentrifuge adapter used in combination with a swinging bucket rotor and an open-top sample tube having a cylindrical upper portion extending from the open top, a bottom conical portion and a hemispherical closed end termination. The adapter per se which is generally cylindrical in configuration has an essentially conical open top interior with hemispherical bottom into which the sample tube bottom conical position and end termination interfit. An annular support rim is formed at the top edge of the adapter adjacent the adapter open end.

The rim has an outer periphery which interfits with a corresponding annular band of the rotor internal periphery. Extending from the adapter rim is a reduced diameter adapter portion extending to the hemispherical bottom which reduced diameter forms with a corresponding annular segment of interior surfaces of the rotor, a gap which permits movement of the tube and adapter outwardly toward the rotor wall without attendant sticking of the tube in the adapter or the adapter in the rotor. In the best mode hereafter described the reduced diameter is a constant diameter and extends from immediately below the annular support rim to its transition with the hemispherical bottom of the adapter.

Another aspect of the invention involves the use of ultra molecular weight (UMW) polyethylene, i.e., 3 million to 6 million MW, which has heretofore not been employed to the knowledge of the inventor in ultracentrifuging applications. This material is strong, tough, machinable, has lubricity, is resistant to chemicals and stress cracking, is autoclavable, has resistance to fatigue cracking and has satisfactory recovery of time-dependent deformation. A UMW polyethylene adapter of constant side wall diameter had a measure of improvement over prior art constructions but still had a tendency to stick after centrifuge operation for a number of hours. The parts could be separated with a water soak and vacuum removal step but this is seen not to be a full solution. The use of an annular support rim on the adapter and a reduced diameter thereunder solved the above sticking problem and was optimized with the use of UMW polyethlene as the adapter material of construction.

Care is taken to optimize the gap between the reduced adapter diameter and the rotor inner periphery so that the gap does not exceed an amount which will allow tube expansion under ultracentrifuging conditions allowing in turn the liquid level in the tube to drop and losing tube wall support provided by the sample liquid. Therefore, it has been found that the dimensioning of the gap between the adapter and rotor and the sample tube and adapter is critical to allow a user to easily remove the sample tube within a few minutes, e.g. ten minutes after the centrifuge has been stopped slowly over a period of about 15 minutes to prevent remixing. The adapter annular support rim prevents expansion of the thin tube wall over the top peripheral edge of the adapter and resultant locking of the tube to the adapter. By the time the centrifuge reaches a few hundred rpm the thin wall sample tube deforms and rests on the top surface of the annular support rim of the adapter. The adapter has relative high thickness at its bottom to withstand expansion even at very high (up to 20,000) rpm.

DETAILED DESCRIPTION OF THE INVENTION

Figure 1:
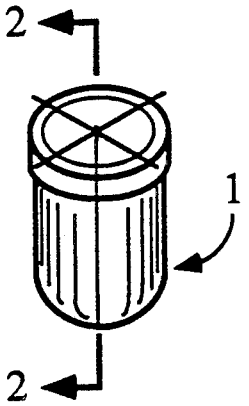
FIG. 1 is a perspective view of the preferred embodiment of the adapter of the present invention.
Figure 2:
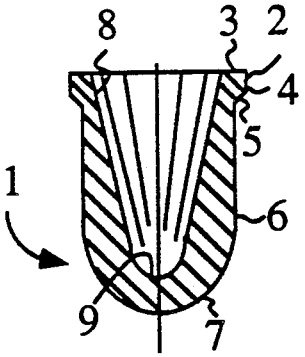
FIG. 2 is a cross sectional view of the adapter of FIG. 1 taken on the line 2—2 of FIG. 1.

The preferred embodiment of the adapter 1 of the present invention is shown in FIGS. 1 and 2. From the top surface 3 of the adapter 1 an annular rim 2 extends approximately 1/16 inch (2 mm) to a rim lower edge 4 and by machining is decreased in diameter by means of a transition region 5 to a reduced diameter segment 6 which continues to an intersection with a hemispherical adapter bottom 7. A reduction of from about 0.004 to 0.006 inches (0.1 mm to 0.2 mm) in the diameter has been found satisfactory. The interior surface of the adapter begins at the open top of the adapter and continues in a taper 8 forming a conical interior surface constantly reducing in diameter to the intersection with a small ¼ inch (6 mm) hemispherical radius 9 at the bottom of the adapter interior.

Figure 3:
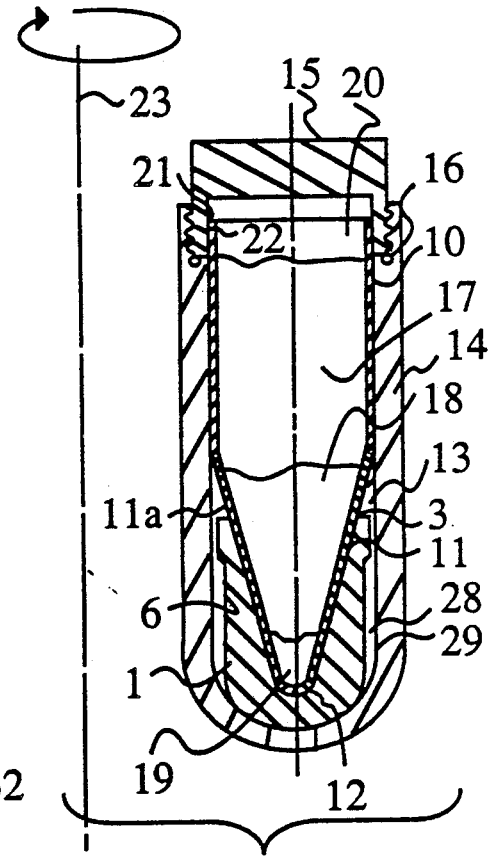
FIG. 3 is a cross-sectional view of a conical sample tube supported by the adapter of FIG. 1 resting vertically in a swinging bucket rotor prior to centrifugation about a vertical axis.

FIG. 3 shows the combination of a conical tube 10 and the adapter 1 inserted in a swinging bucket rotor 14 sealed with a cap 15 and o-ring 16, as it appears vertically before a centrifuge run about vertical axis 23. The spacing between the axis 23 and rotor is not to scale. The tube taper forming a conical section 11 and a hemispherical bottom 12 match exactly the internal surfaces 8 and 9, respectively (FIG. 2) of the adapter. Before centrifugation there exists a space 13 between the top surface 3 of the adapter and an upper surface 11*a* of the conical tapered region of the tube extending beyond and above the adapter. The tube may contain bands 17, 18, and 19 of sample fluid components of varying densities. There exists an unfilled region 20 of the tube so that the fluid contents do not spill over the top 21 of the tube during placement of the rotor in the centrifuge chamber. A small length of tube wall 22 extends unsupported by fluid. There exists initially a gap 28 between the outside reduced diameter 6 of the adapter and the internal diameter 29 of the rotor. In a large unused 1" O.D. tube the gap 28 typically will be about 0.0125" (0.3 mm) on each side while in a smaller unused 7/16" (11 mm) O.D. tube the gap 28 would be about 0.0075" (0.2 mm) on each side. In a large tube of 1" (25 mm) outside diameter, 0.01–0.02 inch (0.5 mm) wall thickness, and 3.5" (89 mm) length, the cylindrical section extends for 0.8" (20 mm) with the transition comical section formed at a 15° taper to a ¼" (6 mm) radius hemispherical termination end. Along a major longitudinal portion of the gap 28, a gap of from about 0.005 inch (0.1 mm) to about 0.015 inch (0.4 mm) is provided.

Figure 4:
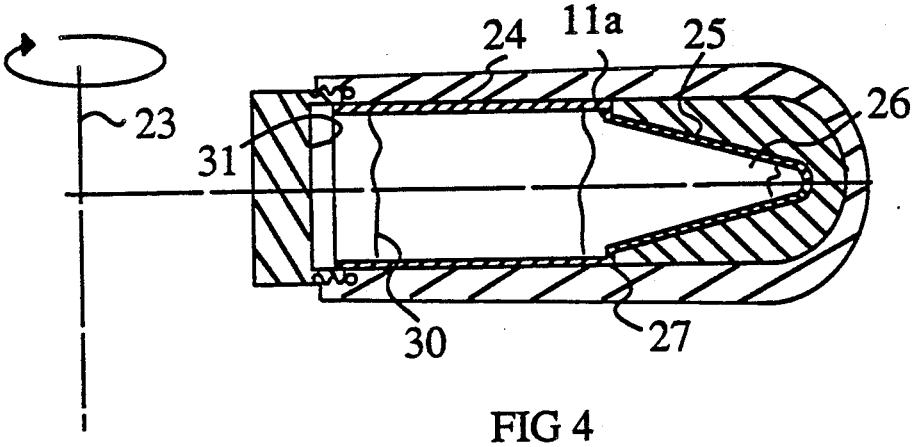
FIG. 4 is a cross-sectional view of the components of FIG. 3 in a horizontal position during centrifugation.

As shown in FIG. 4, during centrifugation the bucket swings 90° from the spin axis 23 to a horizontal position and the fluid contents of the tube move outwardly as pressure increases and expands the tube in the cylindrical tube section 24, pushing the tube wall 25 adjacent to the top surface of the adapter against the top of the adapter thereby eliminating the space 13 which was present before centrifugation. The tube wall essentially acts as a thin wall membrane. Before maximum rotor speed is reached, the tube wall rests on the top surface 3 of the adapter but the pressure in the conical section 26 of the tube has not increased sufficiently to expand the reduced diameter 6 of the adapter against the corresponding surface 29 of the rotor hole. At this point, the all important function of the annular rim at the top of the adapter is realized as it prevents the tube wall portion 11*a* from extruding over the outside top corner 27 of the adapter. If such an extrusion did occur the tube would be permanently deformed over the adapter and could not be separated later.

A construction found to be unsuccessful is one where the annular support rim is eliminated and the entire outside diameter of the adapter is that of a simple reduced diameter. In this case the increased gap at the top would allow the tube wall to extrude over the top of the adapter. The annular support rim is functionally necessary throughout the period in which the rotor speed is increasing to its maximum operating speed as the tube wall moves outward to fill the initial gap 13 at the top of the adapter before the pressure of the fluid inside the adapter increases sufficiently to expand the reduced cylindrical diameter of the adapter outwardly to the bucket rotor interior surface. At operating speeds the pressure in the adapter is sufficient to cause the adapter to increase in diameter until it meets the rotor inside diameter 29 and the initial gap 28 is no longer present. Furthermore, under typical operating speeds of 25,000 to 100,000 rpm fluid pressures are sufficient to expand or bulge the rotor sidewalls outwardly, causing the rotor cavity to be somewhat larger at the bottom than at the top. The adapter reduced cylindrical diameter is no longer reduced and increases until it rests against the rotor hole, regardless of that size. It is apparent that the adapter material must be ductile to prevent cracking but it also must be able to recover fairly quickly elastically at the end of the centrifuge run so that the adapter can be removed from the rotor. When the gaps 13 and 28 at the top and sides of the adapter, respectively, are no longer present, and the rotor bucket expands as the adapter correspondingly expands, there is a movement outwardly from the spin axis (or downwardly from the tube open end) of the innermost fluid meniscus 30 and subsequently the amount of unsupported tube wall 22 increases. If the adapter is designed or inadvertently fabricated so that an excessive reduction in adapter diameter is present, the tube wall unsupported will fold outwardly inside of itself, causing further loss of liquid and catastrophic failure of the tube. Since the adapter is generally constructed of a material less in density than that of the fluid contents of the tube, loss of fluid to regions outside of the tube will cause the adapter to float inward, pushing the tube against the underside surface 31 of the bucket cap and causing more deformation, etc. If, on the other hand, the adapter is constructed with a diameter insufficiently reduced from that of the annular ring, or if there is no reduced diameter at all, there will be insufficient diametrical gap, and the adapter will be remain fixed or stuck in the rotor bucket. Attempts to remove the adapter will result in the formation of a substantial vacuum under the adapter, and its removal will be very difficult.

Figure 5:
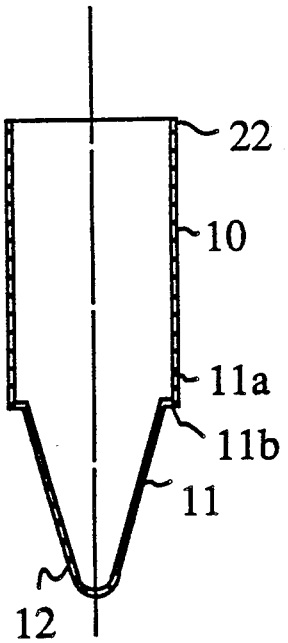
FIG. 5 is a cross-sectional view of a deformed conical tube after centrifugation.

FIG. 5 shows a conical tube after centrifugation with a surface 11*b* of the tube wall which was forced into contact with the top 3 of the adapter rim being permanently deformed in that region. Successful centrifuge runs will result in tubes of this final used configuration. Used tubes may be utilized for a second centrifugation but this is not desirable since the deformed step will cause sample turbulence and mixing as the sample is poured along the tube wall.

Figure 6:
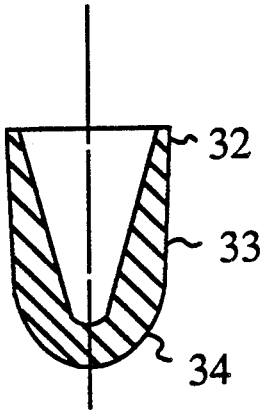
FIG. 6 is a cross-sectional view of an alternate embodiment of an adapter showing a reduced diameter taper below a tube-supporting annular rim.

An alternate embodiment is shown in FIG. 6 where the diameter is reduced immediately adjacent to an annular support rim 32 of constant diameter by means of a machined taper 33 typically of about 0.005/inch (0.1 mm) extending downwardly from rim 32 until intersection with a hemispherical bottom 34. Resultant from the taper an increasingly wider gap is formed extending from the rim to the intersection with bottom 34 and along the inner surface of the rotor corresponding to surface 29 shown in FIG. 3. Since the pressure in the rotor hole, the adapter and sample tube are all directly proportional to the radius of the tube and rotor from the spin axis and the square of the speed the highest stress and adapter deformation is at the adapter bottom where the gap formed by taper 33 is the widest, thus being sufficient to compensate for the expansion of the adapter without the adapter sticking in the rotor upon centrifuge slow up and stopping. A slow deceleration rate is employed to prevent remixing of the sample.

In another embodiment, the reduced diameter is accomplished in a gradual manner by a taper starting immediately below the annular rim.

The above description of embodiments of this invention are intended to be illustrative and not limiting. Other embodiments of this invention will be obvious to those skilled in the art in view of the above disclosure.

I claim:

1. In combination, an ultracentrifuge swinging bucket rotor having a major cylindrical section and an essentially hemispherical closed end, a sample tube insertable into said rotor and an adapter extending between a bottom portion of said tube and said closed end of said rotor;

wherein said tube comprises an upper cylindrical portion having an open-top adapted for sample entry, and wherein said tube bottom portion is essentially conical; and wherein said adapter comprises an essentially conical open top interior for reception of said tube conical bottom portion, an essentially hemispherical bottom seatable in said rotor closed end, a circumferential closed annular support rim surrounding said adapter open top, and a circumferential reduced diameter closed section extending between said rim and said adapter essentially hemispherical bottom and forming a gap with an adjacent rotor wall section, whereby during rotative operation of an ultracentrifuge containing said rotor, said tube and said adapter, said adapter reduced diameter closed section is expandable in said rotor into the gap and after said rotative operation said tube is removable from said rotor for sample retrieval.

2. The combination set forth in claim 1 in which said adapter as constructed of a plastic material having a density of from about 0.9 to about 1.2 grams/cc.

3. The combination set forth in claim 1 wherein said adapter is constructed of an ultra high molecular weight polyethylene.

4. The combination set forth in claim 3 wherein said polyethylene has a molecular weight of from three to six million.

5. The combination set forth in claim 1 in which said adapter has a greater wall thickness in its said essentially hemispherical bottom than at its annular support rim.

6. The combination set forth in claim 1 wherein said adapter reduced diameter section is a tapered surface extending from said adapter annular support rim to said adapter essentially hemispherical bottom.

7. In combination, an ultracentrifuge swinging bucket rotor having a major cylindrical section and an essentially hemispherical closed end, a sample tube insertable into said rotor and an adapter extending between a bottom portion of said tube and said closed end of said rotor;

wherein said tube comprises an upper cylindrical portion having an open-top adapted for sample entry, and wherein said tube bottom portion is essentially conical;

wherein said adapter comprises an essentially conical open top interior for reception of said tube conical bottom portion, an essentially hemispherical bottom seatable in said rotor closed end, an annular support rim adjacent said adapter open top, and a reduced diameter section extending between said rim and said adapter essentially hemispherical bottom, whereby after rotative operation of an ultracentrifuge containing said rotor, said tube and said adapter, said tube is removable from said rotor for sample retrieval; and wherein in an assembled condition in said rotor said adapter annular support rim extends around a top section of said tube conical bottom portion and below said tube upper cylindrical bottom.

8. The combination set forth in claim 7 in which, upon rotation of said rotor, a segment of said tube conical bottom portion above said adapter annular support rim permanently deforms outwardly to abut a top wall surface of said adapter annular support rim and said adapter reduced diameter section expands under ultracentrifuging force into a gap formed between said adapter reduced diameter section and a lower portion of an interior of said rotor cylindrical section.

9. The combination set forth in claim 8 in which said gap extends from said adapter annular support rim to a portion juxtaposed to a junction of an abutment of said adapter essentially hemispherical bottom with said rotor essentially hemispherical closed end.

10. The combination set forth in claim 9 in which a major longitudinal portion of said gap has a gap width from about 0.005 inches (0.1 mm) to about 0.015 inches (0.4 mm) on each side of said adapter juxtaposed to said rotor.

11. In combination, an ultracentrifuge swinging bucket rotor having a major cylindrical section and an essentially hemispherical closed end, a sample tube insertable into said rotor and an adapter extending between a bottom portion of said tube and said closed end of said rotor;

wherein said tube comprises an upper cylindrical portion having an open-top adapted for sample entry, and wherein said tube bottom portion is essentially conical; and wherein said adapter comprises an essentially conical open top interior for reception of said tube conical bottom portion, an essentially hemispherical bottom seatable in said rotor closed end, an annular support rim adjacent said adapter open top, and a reduced diameter section extending between said rim and said adapter essentially hemispherical bottom, whereby after rotative operation of an ultracentrifuge containing said rotor, said tube and said adapter, said tube is removable from said rotor for sample retrieval; and wherein said adapter reduced diameter section is of constant diameter and extends from said adapter annular support rim to said adapter essentially hemispherical bottom.

12. An adapter for retaining an conically ended centrifuge sample tube in a swinging bucket rotor of an ultracentrifuge operable in a range of about 25,000 to about 100,000 rpm comprising:

a generally cylindrical first adapter portion having an open-top end and a conical interior for reception of a conical end of a centrifuge sample tube;

an essentially hemispherical second adapter portion forming a closed end of said adapter;

an integral circumferential annular support rim extending peripherally outward from said first adapter portion adjacent to said open-top end; and a reduced diameter section in said first adapter portion extending between said annular support rim and said second adapter portion, wherein said annular support rim and said second adapter portion fit in close abutment to interior surfaces of a bucket rotor and said reduced diameter section forms a gap with a surrounding segment of interior surfaces of said bucket rotor.

13. The adapter of claim 12 wherein said adapter is constructed of an ultra high molecular weight polyethylene.

14. The adapter of claim 13 wherein said polyethylene has a molecular weight of from three to six million.

15. The adapter of claim 12 in which said adapter is constructed of a plastic material having a density of from about 0.9 to about 1.2 grams/cc.

16. The adapter of claim 12 in which the width of said gap along a major longitudinal portion of said gap is from about 0.005 inches (0.1 mm) to about 0.015 inches (0.4 mm) on each side of said adapter juxtaposed to said rotor.

17. The adapter of claim 12 in which said second adapter portion has a wall thickness greater than a wall thickness of said first adapter portion adjacent to said annular support rim.

18. The adapter of claim 12 wherein said adapter reduced diameter section is of constant diameter.

19. The adapter of claim 12 wherein said adapter reduced diameter section is a tapered surface.

20. The adapter of claim 12 wherein said adapter conical interior terminates in a subsequently hemispherical radius for reception of a corresponding hemispherical radius of a bottom terminal end of a centrifuge sample tube.

21. An adapter for retaining a conical centrifuge sample tube in a swinging bucket rotor of an ultracentrifuge operable in a range of about 25,000 to about 100,000 rpm comprising:

a generally cylindrical first adapter portion having an open-top end and a conical interior for reception of a conical end of a centrifuge sample tube;

an essentially hemispherical second adapter portion forming a closed end of said adapter;

an integral circumferential closed annular support rim extending peripherally outward from said first adapter portion adjacent to said open-top end;

a circumferential reduced diameter closed section extending along said first adapter portion from said rim; and wherein said adapter is constructed of a high molecular weight polyethylene having a molecular weight of from about three million to about six million.

* * * * *